United States Patent [19]

Luke et al.

[11] 3,943,835

[45] Mar. 16, 1976

[54] PRODUCTION OF TOBACCO SMOKE FILTER ROD

[75] Inventors: John A. Luke, Woodlands; Raymond J. Harrison, Southampton, both of England

[73] Assignee: Brown & Williamson Tobacco Corporation, Louisville, Ky.

[22] Filed: June 20, 1974

[21] Appl. No.: 481,094

[30] Foreign Application Priority Data

July 9, 1973 United Kingdom ..... 32546/73

[52] U.S. Cl. ..... 93/77 FT; 93/1 C; 131/261 R

[51] Int. Cl.[2] ..... A24C 5/50

[58] Field of Search ..... 93/1 C, 77 FT; 131/10 R, 131/15 R, 261 R, 267, 268, 269

[56] References Cited

UNITED STATES PATENTS

| | | | |
|---|---|---|---|
| 3,060,814 | 10/1962 | Wagner et al. | 93/1 C |
| 3,128,680 | 4/1964 | Schaaf, Jr. | 93/1 C |
| 3,373,750 | 3/1968 | Beam | 93/77 FT UX |
| 3,405,717 | 10/1968 | Berger et al. | 93/1 C X |
| 3,485,144 | 12/1969 | Willis et al. | 93/1 C |
| 3,824,906 | 7/1974 | Vanhall | 93/77 FT X |

*Primary Examiner*—James F. Coan
*Attorney, Agent, or Firm*—Vance A. Smith

[57] ABSTRACT

The invention relates to a method for wrapping a continuous filter rod and producing tobacco-smoke filter sections which comprises feeding a wrapping strip of a thermoplastics film material, particularly a heat-shrinkable thermoplastics material, past an applicator for applying adhesive to the edges of the strip and, together with a filtering medium, to garniture means for wrapping the said strip around the said medium, which means includes a sealing station consisting of or comprising a cooled long folder, provided with a semicylindrical groove closely matching the rod size and of a length sufficient to permit setting of the adhesive to form a seam between the said edges, and feeding the wrapped rod thus produced to a cut-off device with guiding means for the cut-off sections. Preferably the adhesive is a solvent for the thermoplastics material.

6 Claims, 3 Drawing Figures

PRODUCTION OF TOBACCO SMOKE FILTER ROD

This invention concerns a method for the production of tobacco smoke filter rod. It is primarily concerned with the production of filters of a kind, described in U.S. Pat. No. 3,800,805 and Application Ser. No. 366,756, comprising one or more filter sections and a wrapping of heat-shrinkable thermo-plastics film material. When a cigarette is smoked through such a filter and the burning coal approaches, hot smoke from it will cause the wrapping material to shrink and produce constriction or displacement of a component of the filter.

Methods of wrapping a continuous filter rod or multiple-component filters with normal wrapping material such as paper are well known, but difficulties arise with a wrapping material of thermoplastics film because of the different properties of this material, generally high flexibility and elasticity, low surface friction and a tendency to produce static electricity. The present invention seeks to provide a method and means of production by which such difficulties can be avoided or overcome.

According to the invention, a method of wrapping a continuous filter rod and producing filter sections comprises feeding a wrapping strip of a thermoplastics film material past an applicator for applying adhesive to the edges of the strip and, together with a filtering medium, to garniture means for wrapping the said strip around the said medium, which means includes a sealing station consisting of or comprising a cooled long folder provided with a semicylindrical groove closely matching the rod size and of a length sufficient to permit setting of the adhesive to form a seam between the said edges, and feeding the wrapped rod thus produced to a cut-off device with long guiding means for the cut-off sections. The filtering medium is suitably a cellulose acetate tow, but other fibrous or foam filtering materials may be employed. The method can be usefully applied whether the ultimate product is single or multiple filter sections.

The invention is applicable with particular advantage where the thermo-plastics material is a heat-shrinkable material. Suitable thermoplastics film materials are polyvinylidene chloride, polyethylene, polypropylene, polyester and polystyrene materials slit to strips of width corresponding to normal plug-wrap width, which may be between 10–40 mm, preferably 20–30 mm. The reeled strip may be placed on the bobbin holder of a filter-rod making apparatus, which may be a machine of a known kind except as hereinafter set forth.

The adhesive used is preferably a solvent for the thermoplastics material used.

Figure 1:
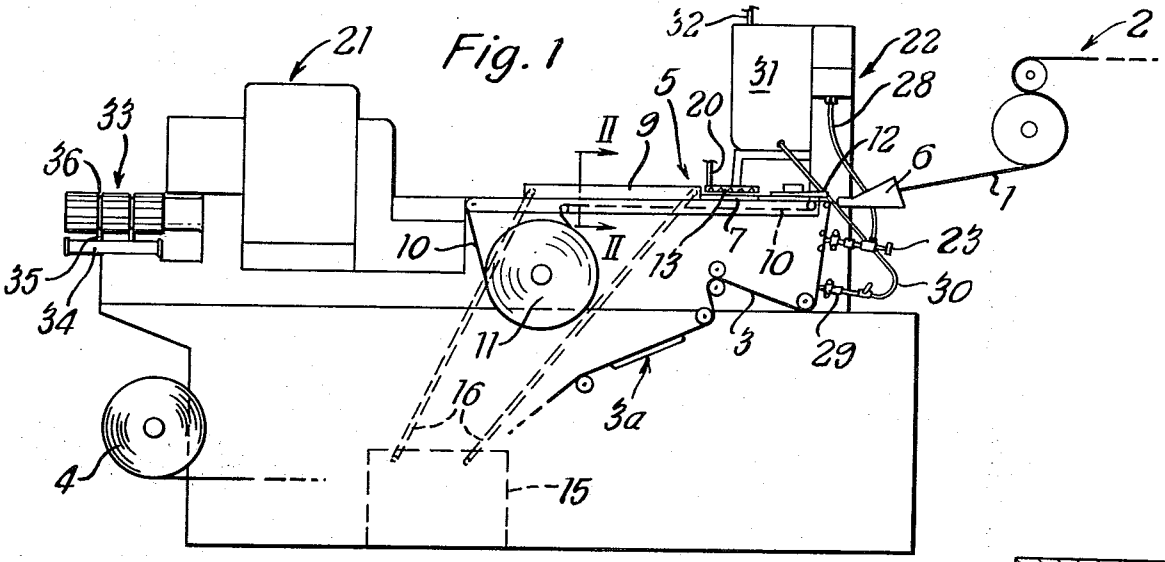
Figure 2:
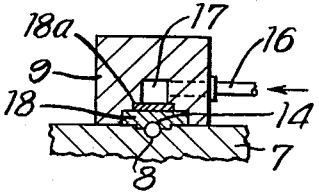

A preferred manner of carrying the invention into effect will now be more fully described by way of example and with reference to the accompanying drawing, in which:

FIG. 1 is a diagrammatic side elevation of a filter-producing apparatus,

FIG. 2 a section to a larger scale on the line II—II in FIG. 1, and

Figure 3:
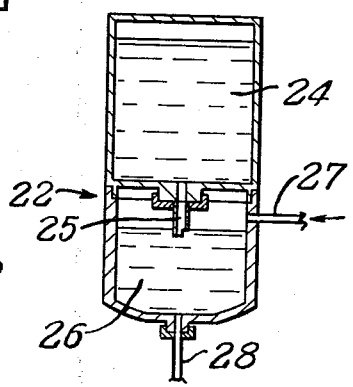

FIG. 3 a vertical section through an adhesive-feeding device, also, to a larger scale.

A tow 1 of filtering material, for example of cellulose acetate fibres, from a two processing unit 2 and a strip 3 of heat-shrinkable thermoplastics film material from a reel 4 are fed to a garniture 5. The unit 2 may comprise tow-opening means of known kind and the tow from it is fed to the garniture 5 through a collecting funnel 6. Because the film material is considerably more flexible than normal paper wrapping material, the strip 3 must be well guided on its path from the reel 4 to the garniture 5. The precise guidance means will naturally depend upon the relative disposition of the reel 4. A suitable arrangement for the right-hand part of the path, including guide rollers and a guiding and supporting surface 3*a*, is shown in FIG. 1. The garniture comprises a lower base plate 7 with a semicylindrical longitudinal groove 8 (FIG. 2) of diameter equal to the diameter of the filter rod to be made plus an allowance, say 1 mm, for the thickness of the usual garniture tape, and a long folder 9. The base plate 7 has a flared entry which allows the garniture tape, initially flat, to be turned upwards at the edges. The garniture tape 10 passes, at the exit end of the garniture, around an expansible drum 11 and thence back to the entry. The garniture also comprises a tongue piece 12 and short folders 13 of conventional design. However, in order to reduce the pressure on the rod and avoid stretching of the film in the short folders 13, these may be raised slightly by shims inserted between them and the base plate 7.

The long folder 9 comprises a block with a semicylindrical longitudinal groove 14 having a diameter equal to that of the groove 8. The block is cooled by either refrigerated water or cooled compressed air. As shown, it is cooled by water circulated through a cooling unit 15 and water pipes 16. The water passes through a longitudinal cavity 17 (FIG. 2) in the block behind an inset plate 18 in which the groove 14 is formed, a water seal 18*a* being interposed. The long folder extends from immediately beyond the short folders 13. The height of the long-folder block 9 may be adjustable, suitably by supporting it pivotably or hingably. Preferably, the short folders 13 are cooled by air supplied at 20 and vented to atmosphere.

Beyond the long folder 9, there is a cut-off device 21 provided with a gauge head, suitably of Solex type, for monitoring the diameter of the wrapped rod. The cut-off device may be of generally known construction, but the gauge head should be of larger size than would conventionally be employed in order to prevent jamming of the rod due to electrostatic forces associated with the thermoplastics film material.

Adhesive for application to one edge of the thermoplastics strip 3 to form an eventual longitudinal seam or like seal is fed from a tank 22 to a nozzle 23, with an adjustable flow-regulating needle valve, which is located just below the entry to the garniture 5. The adhesive may be so fed under gravity or applied pressure. Preferably, however, it is fed under a controlled head by the arrangement shown in FIG. 3, whereby an even feed can be ensured. Adhesive from a reservoir 24 passes under gravity through a tube 25 with a stepped outlet into a chamber 26 to which air at atmospheric pressure is admitted at 27. The adhesive passes from the chamber 26 to the nozzle 23 through a tube 28. Preferred adhesives are ethyl acetate, methylisobutyl ketone or tetrahydrofurfuryl alcohol. Other suitable adhesives are ketone-type adhesives, such as methyl ethyl ketone, acetone, or cyclohexanone, mixtures thereof, possibly together with tetrahydrofurfural, or an alcohol, for instance, tetrahydrofurfuryl alcohol.

Located below the nozzle 23 is a second nozzle 29 which applies to the film 3, along its center line, gum fed through a tube 30 from a container 31 which is maintained under the pressure of compressed air supplied at 32. This gum will serve to bind the rod of filtering material to the wrapper in known manner. A suitable gum is polyvinyl acetate.

In the operation of the apparatus so far described, the tow from the funnel 6 and the film tape 3, furnished with the seam adhesive and gum, together enter the garniture 5 on the garniture tape in the usual manner. The rod, formed by the wrapping action of the tongue 12 and short folders 13, is fed through the long folder 9 in which setting of the adhesive occurs. The temperature of this folder is preferably 5° below ambient temperature, suitably 0° to 30°C, to avoid damage to the film and prevent evaporation of the solvent. The temperature and rate of circulation of the cooling medium must be adjusted for maintaining the temperature. The length of the long folder must be suitable for the purpose, having regard to the rate of rod feed and the cooling provided. In a typical case, a length of 43 cm and a temperature of 25°C were found to be appropriate. As indicated above, the profile of the channel 8,14 is designed closely to match the rod diameter so that the tow and strip become almost totally enrobed in the garniture tape. This reduces friction and assists in securing good setting of the adhesive and minimum risk of side slip of the seam between the strip edges during setting.

When the long folder 9 is clamped down to the garniture base 7, it should totally enclose the enrobed rod. However, the apparatus should be operated with a relatively low pressure in the folder. This is necessary in order to reduce problems associated with the driving of a thermoplastics material having a low friction coefficient and to avoid squashing the rod, and/or overstretching the film and/or tow. On the other hand, if the pressure is excessively reduced, it will not be possible to maintain the drive without considerable slip. Sufficient bulk filling of the filter rod and suitable filling of the long folder for a required pressure can be obtained by selection of the properties of the tow.

Beyond the long folder, the wrapped rod produced passes, without the garniture tape 10, into the cut-off device 21. Because the rod may be more flexible than a normal filter rod, it may be advantageous, for the better control of the rod, to extend the length of the usual ledgers in the cut-off device. Also channel guides may be provided at the approach to the ledgers and at the exit to ensure that the cut sections, which are pliable, remain in the prescribed path.

The cut-off sections are conveyed by way of a conventional fluted drum 33 to a catcher belt 34 below, the sections being removed by ejectors or pickers 35 projecting from below into circumferential grooves 36 in the drum. Due to electrostatic forces, the rod sections tend to cling to the surface of the flutes. To assist removal, therefore, provision is made for blowing the sections from the drum 33 by compressed air applied inside the bottom part of the latter. Ionized air jets may also be employed to overcome or reduce build-up of static electricity on the rod. Such jets may be located at convenient positions between the exit of the garniture 5 and the drum 33.

If the filtering material is cellulose acetate tow, the properties of the tow are important. Preferably a tow of high packing density is chosen in order to obtain a rod of good shape, good length and good smoking properties, for example 300,000–80,000 g total denier preferably 37,000–50,000 g total denier. Instead of a tow, the filtering medium may be paper or a known foam filtering material.

We claim:

1. A method of wrapping a continuous filter rod and producing tobacco-smoke filter sections, comprising feeding without heating a wrapping strip of a heat-shrinkable thermoplastics film material past an applicator for applying adhesive to the edges of the strip and, together with a filtering medium, to garniture means for wrapping the said strip around the said medium, which means includes a sealing station comprising a cooled long folder provided with a semicylindrical groove closely matching the rod size and of a length sufficient to permit setting of the adhesive to form a seam between the said edges, and feeding the wrapped rod thus produced to a cut-off device with guiding means for the cut-off sections.

2. A method according to claim 1, wherein the wrapping strip and filter medium are fed to the long folder by way of a short folder which is also cooled, the cooling of the short folder being effected by a flow of air through the folder.

3. A method according to claim 1, wherein the adhesive is a solvent for the thermoplastics material.

4. A method according to claim 1, wherein the filter medium comprises a cellulose acetate tow.

5. A method according to claim 1, wherein the wrapping strip and filter medium are fed to the long folder by way of a short folder which is also cooled.

6. A method according to claim 1, wherein the cooling of the long folder is effected by a flow of cold water through the folder.

* * * * *

UNITED STATES PATENT OFFICE

CERTIFICATE OF CORRECTION

Patent No. 3,943,835 Dated March 16, 1976

Inventor(s) John A. Luke, Raymond J. Harrison

It is certified that error appears in the above-identified patent and that said Letters Patent are hereby corrected as shown below:

Column 1, line 67, delete "two" and insert therefor --tow--.

Column 4, line 18, delete "300,000" and insert therefor --30,000--.

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*